US011326416B1

(12) United States Patent
Zheng et al.

(10) Patent No.: US 11,326,416 B1
(45) Date of Patent: May 10, 2022

(54) SPIRAL DEPLOYED ISOLATION TOOL

(71) Applicant: Vertechs Petroleum Technology Innovation & Equipment Manufacturing Co., LTD, Chengdu (CN)

(72) Inventors: Wei Zheng, Chengdu (CN); Qijun Zeng, Chengdu (CN)

(73) Assignee: VERTECHS PETROLEUM TECHNOLOGY INNOVATION & EQUIPMENT MANUFACTURING CO., LTD, Chengdu (CN)

( * ) Notice: Subject to any disclaimer, the term of this patent is extended or adjusted under 35 U.S.C. 154(b) by 0 days.

(21) Appl. No.: 17/401,361

(22) Filed: Aug. 13, 2021

(30) Foreign Application Priority Data

Jun. 23, 2021 (CN) ..... 202110697045.9

(51) Int. Cl.
*E21B 33/129* (2006.01)
*E21B 33/12* (2006.01)

(52) U.S. Cl.
CPC ..... *E21B 33/1292* (2013.01); *E21B 33/1208* (2013.01)

(58) Field of Classification Search
CPC ..... E21B 33/1292; E21B 33/1208
See application file for complete search history.

(56) References Cited

U.S. PATENT DOCUMENTS

| | | | | |
|---|---|---|---|---|
| 3,412,803 | A * | 11/1968 | Stachowiak | E21B 33/1293 166/134 |
| 9,976,379 | B2 * | 5/2018 | Schmidt | E21B 33/129 |
| 2017/0130553 | A1 * | 5/2017 | Harris | E21B 33/1208 |
| 2018/0016864 | A1 * | 1/2018 | Parekh | E21B 43/26 |
| 2018/0135380 | A1 * | 5/2018 | Saulou | E21B 33/128 |
| 2019/0017600 | A1 * | 1/2019 | Scharrer | F16J 9/14 |
| 2021/0247011 | A1 * | 8/2021 | Zhang | F16J 15/065 |

* cited by examiner

*Primary Examiner* — Taras P Bemko
(74) *Attorney, Agent, or Firm* — Bayramoglu Law Offices LLC

(57) ABSTRACT

A spiral deployed isolation tool includes a central pipe having an outer surface in a conical shape and an axial through hole, and an anchoring sealing structure. The anchoring sealing structure is matched and sleeved on the outer surface of the central pipe. The anchoring sealing structure has a first sealing section and an anchoring section. The first sealing section is located at a larger end of the central pipe. The anchoring section includes a plurality of slips, the first sealing section includes a plurality of first spiral sealing rings. The plurality of slips 221 correspond to the plurality of first spiral sealing rings one by one to respectively form an integral structure. The plurality of slips are uniformly expanded in a radial direction, thereby achieving uniform circumferential distribution of slips, so that the slips are evenly anchored on an inner wall of the whole wellbore.

17 Claims, 6 Drawing Sheets

SPIRAL DEPLOYED ISOLATION TOOL

CROSS REFERENCES TO THE RELATED APPLICATIONS

This application is based upon and claims priority to Chinese Patent Application No. 202110697045.9, filed on Jun. 23, 2021, the entire contents of which are incorporated herein by reference.

TECHNICAL FIELD

The present invention relates to the field of oil downhole construction, and particularly relates to a spiral deployed isolation tool.

BACKGROUND

In the process of achieving the setting of a deployed isolation tool in the downhole, a slip of the deployed isolation tools expanded and pressed onto an inner wall of a wellbore. The slip is generally composed of multiple slip pieces. In the process that the slip is being expanded, due to the uneven force on the slip in the radial direction, the slip will be expanded firstly at the place with a larger force. Since the force on the firstly expanded slip will be increased continuously, the expansion of the slip at this place is larger than the expansion of the slip at other places, which causes uneven expanding and anchoring of the slip in the inner wall of the whole wellbore, reduces the bearing capacity of the deployed isolation tool in the radial direction, and affects the sealing and bearing effect of the deployed isolation tool. Further, the mandrel is likely to fall out, resulting in the failure of isolation.

SUMMARY

The present invention provides a spiral deployed isolation tool for solving the above technical problem, so as to improve the bearing capacity of the deployed isolation tool in an axial direction.

The technical solution of the present invention for solving the above technical problem is as follows: a spiral deployed isolation tool, including:

a mandrel having an outer surface in a conical shape, and having an axial through hole; and an anchoring sealing structure, wherein the anchoring sealing structure is matched and sleeved on the outer surface of the mandrel, the anchoring sealing structure has a first sealing section and an anchoring section, the first sealing section is located at a larger end of the mandrel, the anchoring section includes a plurality of slips, the first sealing section includes a plurality of first spiral sealing rings, the plurality of slips correspond to the plurality of first spiral sealing rings one by one to respectively form an integral structure, and the plurality of first spiral sealing rings are nested with each other to form the first sealing section.

The working principle and advantages of the present invention are as follows. In the process of the downhole running of the deployed isolation tool, the anchoring sealing structure is driven to move relatively on the mandrel and is expanded radially through a downhole tool. Since the slips correspond to the first spiral sealing rings one by one to respectively form an integral structure, and the slip is also expanded under its radial expanding force during the expanding process of the first sealing section. Specifically, the plurality of first spiral sealing rings are nested with each other to form the first sealing section. In the first sealing section, the radial expanding force on each first spiral sealing ring is uniform so each first spiral sealing ring is also uniformly expanded in a radial direction, thereby driving the plurality of slips to be evenly expanded in the radial direction, and achieving uniform circumferential distribution of slips. In this way, the slips are evenly expanded and anchored on the inner wall of the whole wellbore, thereby ensuring the uniformity of the bearing capacity of the deployed isolation tool in the radial direction and improving the sealing and bearing effect of the deployed isolation tool. Moreover, since the sealing sections are the first spiral sealing rings nested with each other, the sealing section of the spiral structure needs a certain initial force to make the sealing section expanded and inflated, which can produce the effect of preventing the early setting.

On the basis of the above technical solution, the present invention can further make the following improvement.

Further, the anchoring sealing structure also has a locking body. The locking body is located at a smaller end of the mandrel. The mandrel is provided with a locking structure fitted with the locking body. The locking body includes a plurality of spiral locking rings, the plurality of slips correspond to the plurality of spiral locking rings one by one to respectively form an integral structure, and the plurality of spiral locking rings are nested with each other to form the locking body.

The advantages of adopting the above further solution are as follows: the locking body is disposed on the anchoring sealing structure, and is fitted and locked with the locking structure on the mandrel and when the anchoring sealing structure reaches a predetermined position and realizes the sealing of wellbore, the plurality of spiral locking rings of the locking body have the effect of retracting in the radial direction, which ensures the locking and fitting between the spiral locking ring and the locking structure, prevents the anchoring sealing structure from falling off from the mandrel, and improves the reliability of sealing and locking of the deployed isolation tool.

On the basis of the above technical solution, the present invention can further make the following improvement.

Further, the locking structure is a locking groove, and a width of the locking groove in an axial direction of the mandrel is larger than a pitch of the spiral locking ring.

The advantages of adopting the above further solution are as follows. The width of the locking groove in the axial direction of the mandrel is larger than the pitch of the spiral locking ring, which ensures a part of spiral locking rings retract to the locking groove through its own elastic force when the tool completes the setting, thereby ensuring the limiting and locking effect of the locking structure.

On the basis of the above technical solution, the present invention can further make the following improvement.

Further, a surface of the locking structure and an inner surface of the locking body are provided with a plurality of locking teeth matched with each other.

The advantage of adopting the above further solution is as follows. The plurality of locking teeth is configured to ensure the effect of mutually locking.

On the basis of the above technical solution, the present invention can further make the following improvement.

Further, the locking groove is a locking concave groove, the locking concave groove has a groove side in the radial direction of the mandrel, the groove side far away from the smaller end of the mandrel is an inclined side, and an opening of the inclined side is far away from the smaller end of the mandrel.

The advantages of adopting the above further solution are as follows. The locking concave groove is configured to simplify the structure of the locking structure by directly utilizing the retracted spiral locking ring to be matched and locked with the locking concave groove. Moreover, the groove side is disposed to be the inclined side, after the anchoring seal structure is driven to move to the locking concave groove, the first spiral sealing ring in the first sealing section can smoothly move out from the locking concave groove along the inclined side under the action of external pushing force, thereby ensuring the reliability of downhole working of the deployed isolation tool and reliably sealing and locking the wellbore through the anchoring sealing structure.

On the basis of the above technical solution, the present invention can further make the following improvement.

Further, a pitch of the spiral locking ring is smaller than the width of the locking groove in the axial direction of the mandrel, and the width of the locking groove in the axial direction of the mandrel is smaller than the pitch of the first spiral sealing ring.

The advantages of adopting the above further solution are as follows. The pitch of the spiral locking ring is smaller than that of the first spiral sealing ring, so the spiral locking ring can be disposed to be shorter in the axial direction, thereby reducing a length of the whole deployed isolation tool. Moreover, after the anchoring sealing structure is driven to move to the locking concave groove, the first spiral sealing ring in the first sealing section cannot fall into the locking structure matched with the spiral locking ring, which will not affect the downhole working efficiency of the deployed isolation tool.

On the basis of the above technical solution, the present invention can further make the following improvement.

Further, the anchoring sealing structure also has a second sealing section. The second sealing section is located between the anchoring section and the locking body. The second sealing section includes a plurality of second spiral sealing rings. The plurality of second spiral sealing rings are located on extending lines of spiral lines of the plurality of spiral locking rings, and correspond to the plurality of slips one by one to respectively form an integral structure. The plurality of second spiral sealing rings are nested with each other to form the second sealing section.

The advantages of adopting the above further solution are as follows. The second sealing section is configured to realize the effect of multi-stage sealing of the deployed isolation tool, and improve the reliability of sealing.

On the basis of the above technical solution, the present invention can further make the following improvement.

Further, the pitch of the spiral locking ring is smaller than the width of the locking groove in the axial direction of the mandrel, and the width of the locking groove in the axial direction of the mandrel is smaller than the pitch of the second spiral sealing ring.

The advantages of adopting the above further solution are as follows. After the anchoring sealing structure is driven to move to the locking concave groove, the second spiral sealing ring cannot fall into the locking structure matched with the spiral locking ring, which will not affect the downhole working efficiency of the deployed isolation tool.

On the basis of the above technical solution, the present invention can further make the following improvement.

Further, the mandrel is provided with a sealing rubber cylinder and a stop ring. One end of the sealing rubber cylinder is butted with the first sealing section, and the other end of the sealing rubber cylinder is butted with the stop ring.

The advantages of adopting the above further solution are as follows. The sealing rubber cylinder is configured for a further sealing. Moreover, the stop ring prevents the sealing rubber cylinder from being inflated toward the axial direction, so that the sealing reliability of the sealing rubber cylinder is improved.

On the basis of the above technical solution, the present invention can further make the following improvement.

Further, the stop ring is a spiral stop ring.

The advantages of adopting the above further solution are as follows. The spiral stop ring is spirally expanded in the radial direction, such that the stop ring cannot be broken and cracked, thereby improving the axial blocking effect of the sealing rubber cylinder. Moreover, the spiral stop ring needs a certain initial force to be expanded and inflated, which can produce the effect of preventing the early setting of the deployed isolation tool.

On the basis of the above technical solution, the present invention can further make the following improvement.

Further, an outer surface of the first spiral sealing ring is provided with a sealing protrusion.

The advantages of adopting the above further solution are as follows. When the first spiral sealing ring is subjected to a radial pressure, a surface area of the protrusion is relatively small, so under the same pressure condition, the pressure on a protrusion position is relatively large. In this way, the protrusion is easily pressed onto the inner wall of the wellbore to form a sealing with the inner wall of the wellbore, thereby improving the sealing effect.

On the basis of the above technical solution, the present invention can further make the following improvement.

Further, an outer surface of the second spiral sealing ring is provided with the sealing protrusion.

The advantages of adopting the above further solution are as follows. When the second spiral sealing ring is subjected to the radial pressure, a surface area of the protrusion is relatively small, so under the same pressure condition, the pressure on the protrusion position is relatively large. In this way, the protrusion is easily pressed onto the inner wall of the wellbore to form a sealing with the inner wall of the wellbore, thereby improving the sealing effect.

Figure 1:
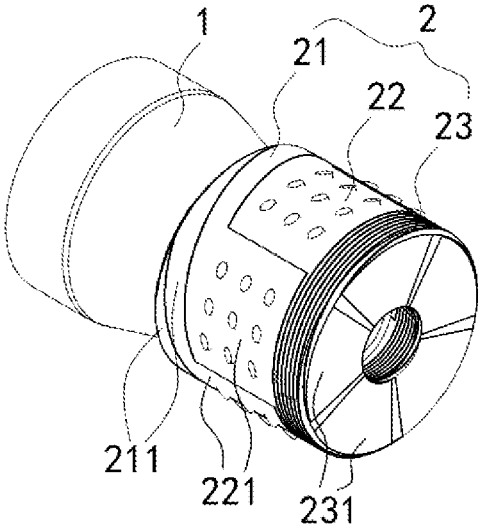
FIG. 1 is a three-dimensional structure schematic diagram of Embodiment I of a spiral deployed isolation tool of the present invention.
Figure 2:
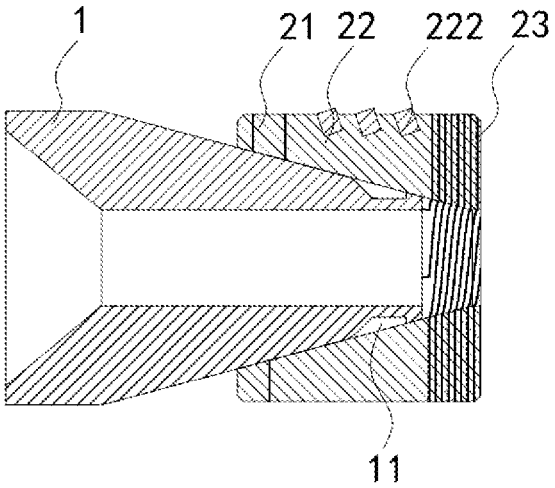
FIG. 2 is a sectional view in one direction of Embodiment I.
Figure 3:
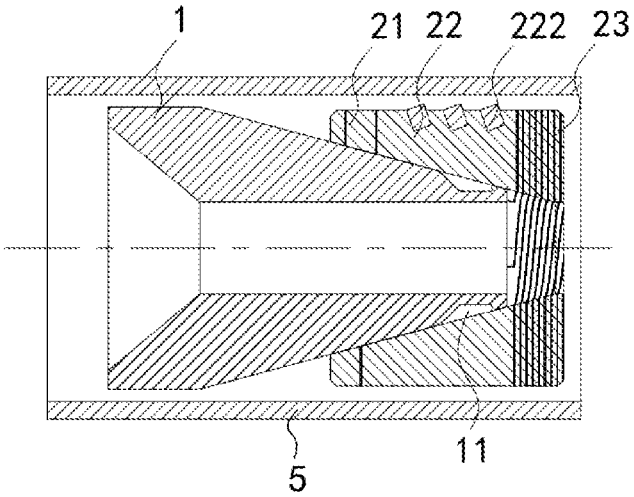
FIG. 3 is a schematic diagram of a first working state of Embodiment I.

In the drawings, a list of components represented by each reference is as follows:

1. mandrel, 11. locking structure, 2. anchoring sealing structure, 21. first sealing section, 211. first spiral sealing ring, 22. anchoring section, 221. slip, 222. slip tooth, 23. locking body, 231. spiral locking ring, 24. second sealing section, 241. second spiral sealing ring, 3. sealing rubber cylinder, 4. stop ring, and 5. wellbore.

DETAILED DESCRIPTION OF THE EMBODIMENTS

The principles and features of the present invention are described below in combination with the drawings, and the described embodiments are only used for explaining the present invention, rather than limiting the scope of the present invention.

The structural schematic diagram of Embodiment I of a spiral deployed isolation tool of the present invention refers to FIGS. 1 to 4.

A spiral deployed isolation tool includes the mandrel 1 having an outer surface in a conical shape and an axial through hole; and the anchoring sealing structure 2, wherein the anchoring sealing structure 2 is matched and sleeved on the outer surface of the mandrel 1. The anchoring sealing structure 2 includes the first sealing section 21 and the anchoring section 22. The first sealing section 21 is located at a larger end of the mandrel 1. The anchoring section 22 includes a plurality of slips 221. The first sealing section 21 includes a plurality of first spiral sealing rings 211, the plurality of slips 221 correspond to the plurality of first spiral sealing rings 211 one by one to respectively form an integral structure. The plurality of first spiral sealing rings 211 are nested with each other to form the first sealing section 21.

In the present embodiment, the number of the slips 221 is five, that is, the number of the corresponding first spiral sealing rings 211 is also five. The five first spiral sealing rings 211 are nested with each other to form the first sealing section 21. Each slip 221 is provided with nine slip teeth 222.

The working principle and advantages of the present embodiment are as follows. In the process of the downhole running of the deployed isolation tool, the anchoring sealing structure 2 is driven to move relatively on the mandrel 1 and is expanded radially through a downhole tool. Since the slips 221 correspond to the first spiral sealing rings 211 one by one to respectively form an integral structure. The slip 221 is also expanded under its radial expanding force during the expanding process of the first sealing section 21. Specifically, the five first spiral sealing rings 211 are nested with each other to form the first sealing section 21. In the first sealing section 21, the radial expanding force on each first spiral sealing ring 211 is uniform, so each first spiral sealing ring 211 is also uniformly expanded in a radial direction, thereby driving the plurality of slips 221 to be evenly expanded in the radial direction, and achieving uniform circumferential distribution of slips. In this way, the slips 221 are evenly expanded and anchored on the inner wall of the whole wellbore, thereby ensuring the uniformity of the bearing capacity of the deployed isolation tool in the radial direction and improving the sealing and bearing effect of the deployed isolation tool. Moreover, since the sealing sections are composed of the first spiral sealing rings 211 nested with each other, the sealing section of the spiral structure needs a certain initial force to be expanded and inflated, which can produce the effect of preventing the early setting.

In the present embodiment, the anchoring sealing structure 2 also has the locking body 23. The locking body 23 is located at a smaller end of the mandrel 1. The mandrel 1 is provided with the locking structure 11 fitted with the locking body 23. The locking body 23 includes a plurality of spiral locking rings 231. The plurality of slips 221 correspond to the plurality of spiral locking rings 231 one by one to respectively form an integral structure. The plurality of spiral locking rings 231 are nested with each other to form the locking body 23.

Specifically, the locking structure 11 is a locking groove, and a width of the locking groove in an axial direction of the mandrel 1 is larger than a pitch of the spiral locking ring 231. The locking groove is a locking concave groove. The locking concave groove has a groove side in the radial direction of the mandrel 1. The groove side far away from the smaller end of the mandrel 1 is an inclined side, and an opening of the inclined side is far away from the smaller end of the mandrel 1. In the present embodiment, the width of the locking concave groove is 1.2 times the pitch of the spiral locking ring 231. Since there are five spiral locking rings 231 in the present embodiment, one pitch of any spiral locking ring 231 includes five spiral locking rings 231 (including the any spiral locking ring 231 itself), which ensures that partial sections of the five spiral locking rings 231 used for locking can fall into the locking concave groove, and the locking and return-preventing effects are reliable.

The locking body 23 is disposed on the anchoring sealing structure 2, and is fitted and locked with the locking structure 11 on the mandrel 1. When the anchoring sealing structure 2 reaches a predetermined position to seal the wellbore, the plurality of spiral locking rings 231 of the locking body 23 have the effect of retracting in the radial direction, which ensures the locking and fitting between the spiral locking ring 231 and the locking structure 11, prevents the anchoring sealing structure 2 from falling off from the mandrel 1, and improves the reliability of sealing and locking of the deployed isolation tool. The locking concave groove is configured to simplify the structure of the locking structure 11 by directly utilizing the retracted spiral locking ring 231 to be matched and locked with the locking concave groove. Moreover, the groove side is disposed to be the inclined side. After the anchoring seal structure moves to the locking concave groove, the first spiral sealing ring 211 in the first sealing section 21 can smoothly move out from the locking concave groove along the inclined side under the action of external pushing force, thereby ensuring the reliability of downhole working of the deployed isolation tool and enabling the anchoring sealing structure 2 to reliably seal and lock the wellbore.

Figure 4:
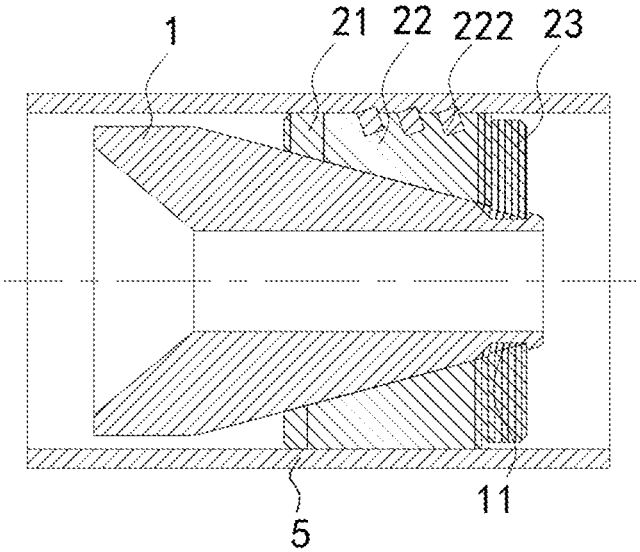
FIG. 4 is a schematic diagram of a second working state of Embodiment I.

In the present embodiment, as shown in FIG. 4, after the five first spiral sealing rings 211 are nested with each other to form the first sealing section 21 and to be in sealing connection with the inner wall of the wellbore 5, the slip teeth 222 of the slips 221 are anchored with the inner wall of the wellbore 4. Meanwhile, the spiral sealing ring 231 falls into the locking concave groove, thereby achieving locking and return-preventing functions.

In the present embodiment, the five first spiral sealing rings 211 are in the same plane at the ends to ensure that the pressure of the well fluid on the anchoring sealing structure 2 is equalized after setting.

Figure 5:
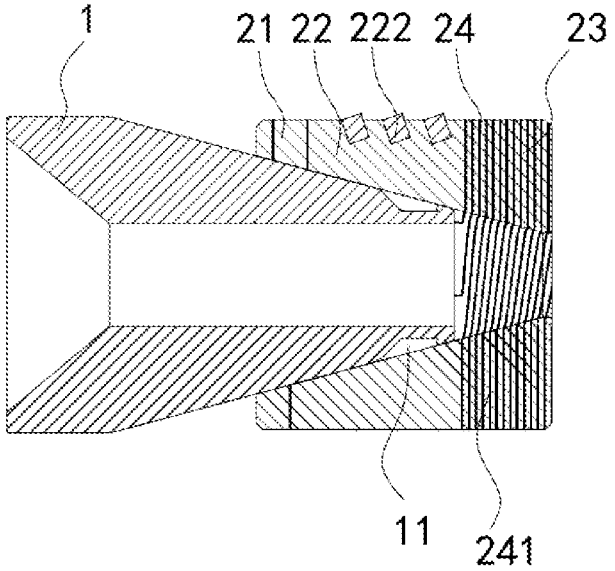
FIG. 5 is a sectional view in one direction of Embodiment II.
Figure 6:
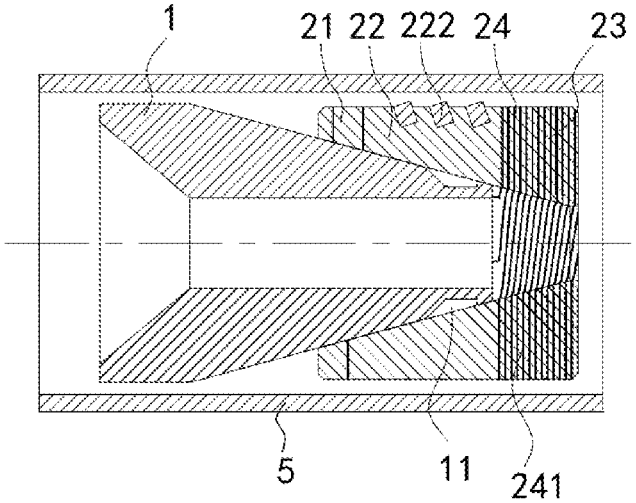
FIG. 6 is a schematic diagram of a first working state of Embodiment II.
Figure 7:
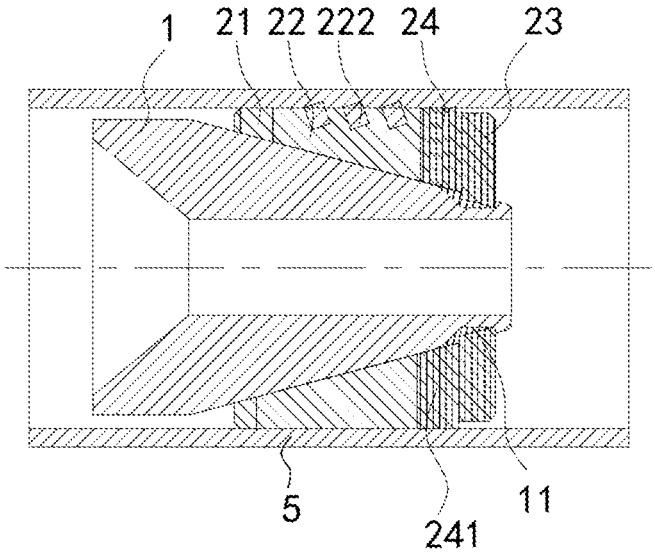
FIG. 7 is a schematic diagram of a second working state of Embodiment II.

The structural schematic diagram of Embodiment II refers to FIGS. 5 to 7. The distinction between the present embodiment and Embodiment I is that the anchoring sealing structure 2 also has the second sealing section 24. The second sealing section 24 is located between the anchoring section 22 and the locking body 23. The second sealing section 24 includes a plurality of second spiral sealing rings 241. The plurality of second spiral sealing rings 241 are located on extending lines of spiral lines of the plurality of spiral locking rings 231, and correspond to the plurality of slips 221 one by one to respectively form an integral structure. The plurality of second spiral sealing rings 241 are nested with each other to form the second sealing section 24.

The second sealing section 24 is configured to realize the effect of multi-stage sealing of the deployed isolation tool, and improve the reliability of sealing.

In the present embodiment, a pitch of the spiral locking ring 231 is smaller than a width of the locking groove in the axial direction of the mandrel 1, and the width of the locking groove in the axial direction of the mandrel 1 is smaller than the pitch of the first spiral sealing ring 211 and the pitch of the second spiral sealing ring 241.

By the arrangement of the above structures, the spiral locking ring 231 can be disposed to be shorter in the axial direction, thereby reducing a length of the whole deployed isolation tool. Moreover, after the anchoring sealing structure 2 is driven to move to the locking groove, the first spiral sealing ring 211 in the first sealing section 21 and the second spiral sealing ring 241 in the second sealing section 24 cannot fall into the locking structure 11 (that is, the locking groove) matched with the spiral locking ring 231, which will not affect the downhole working efficiency of the deployed isolation tool.

Figure 8:
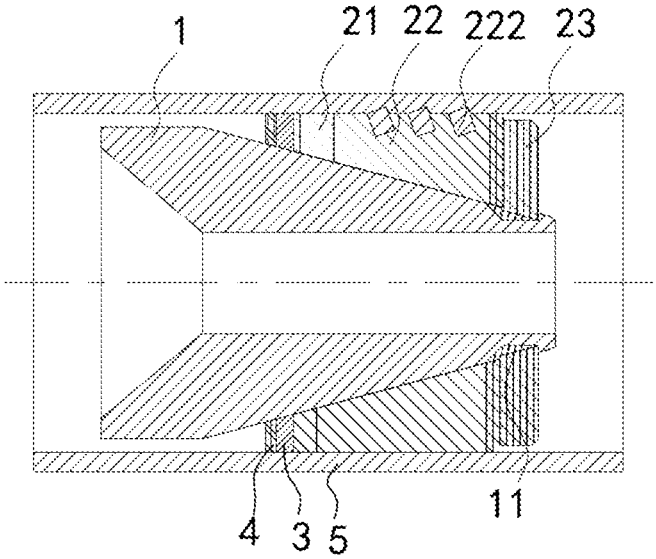
FIG. 8 is a schematic diagram of a second working state of Embodiment III.

The structural schematic diagram of Embodiment III of the present invention refers to FIG. 8. The distinction between the present embodiment and Embodiment I lies in that the mandrel 1 is provided with the sealing rubber cylinder 3 and the stop ring 4. One end of the sealing rubber cylinder 3 is butted with the first sealing section 21, and the other end of the sealing rubber cylinder 3 is butted with the stop ring 4. Specifically, the stop ring 4 is a spiral stop ring.

The sealing rubber cylinder 3 is configured to realize the multi-stage sealing, and the stop ring 4 is configured to prevent the sealing rubber cylinder 3 from being inflated toward the axial direction, which improves the sealing reliability of the sealing rubber cylinder 3. Moreover, the spiral stop ring is spirally expanded in the radial direction, and the stop ring will not be broken and cracked, thereby improving the axial stop effect of the sealing rubber cylinder 3. Since the spiral stop ring needs a certain radial pressure when being expanded, it can further improve the effect of preventing the early setting.

Optionally, the sealing rubber cylinder 3 is a soluble sealing rubber cylinder capable of being easily dissolved in the downhole environment, and the stop ring 4 is a soluble sealing rubber cylinder capable of being easily dissolved in the downhole environment.

Figure 9:
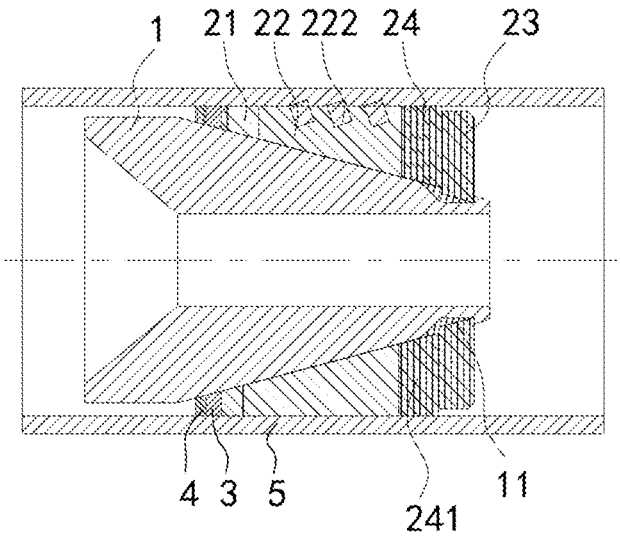
FIG. 9 is a schematic diagram of a second working state of Embodiment IV.

The structural schematic diagram of Embodiment IV of the present invention refers to FIG. 9. The distinction between the present embodiment and Embodiment II lies in that the mandrel 1 is provided with the sealing rubber cylinder 3 and the stop ring 4. One end of the sealing rubber cylinder 3 is butted with the first sealing section 21, and the other end of the sealing rubber cylinder 3 is butted with the stop ring 4. Specifically, the stop ring 4 is a spiral stop ring.

Figure 10:
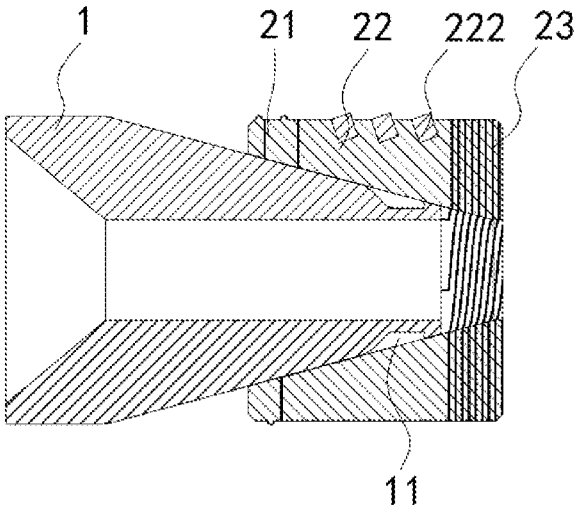
FIG. 10 is a sectional view in one direction of Embodiment V.
Figure 11:
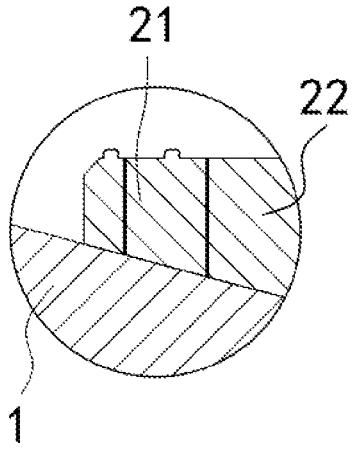
FIG. 11 is a partial view of a protrusion portion in Embodiment V.

The structural schematic diagram of Embodiment V of the present invention refers to FIGS. 10 to 11, in the present embodiment, an outer surface of the first spiral sealing ring 211 is provided with a sealing protrusion.

When the first spiral sealing ring 211 is subjected to the radial pressure, a surface area of the protrusion is relatively small, so under the same pressure condition, the pressure on the protrusion position is relatively large. In this way, the protrusion is easily pressed into the inner wall of the wellbore to form a sealing with the inner wall of the wellbore, thereby improving the sealing effect.

In a specific embodiment, an outer surface of the second spiral sealing ring 241 can also be provided with a sealing protrusion.

Similarly, when the second spiral sealing ring 241 is subjected to the radial pressure, a surface area of the protrusion is relatively small, so under the same pressure condition, the pressure on the protrusion position is relatively large. In this way, the protrusion is easily pressed into the inner wall of the wellbore to form a sealing with the inner wall of the wellbore, thereby improving the sealing effect.

In a specific embodiment, a surface of the locking structure 11 and an inner surface of the locking body 23 are provided with a plurality of locking teeth matched with each other. The plurality of locking teeth is configured to ensure the effect of mutually locking.

In a specific embodiment, the total number of the spiral locking ring 231 and the slips 221 can be adjusted according to application requirements.

In a specific embodiment, the locking structure 11 can be disposed as a spiral structure matched in the spiral direction of the spiral locking ring 231. In this way, most of the spiral locking rings 231 can fall into the locking structure 11 and contact with its fitting surface, so that the spiral locking ring 231 has a larger contact area with the locking structure 11 in the radial direction, thereby improving the reliability of the locking and limiting of the spiral locking ring 231 and the locking structure 11. For example, the spiral locking ring 231 and the locking structure 11 are disposed as a locking tooth structure, a spiral groove structure, etc., which are mutually locked. Preferably, the length of the locking structure 11 thereof is more than half of the whole circle of thread, which can ensure the reliability of the locking and limiting of the spiral locking ring 231 of the spiral structure matched therewith falling into the locking structure 11.

In a specific embodiment, the length of the first spiral sealing ring 211 can be disposed to be at least one circle, so that the first sealing section 21 formed by the plurality of first spiral sealing rings 211 has a sufficient sealing length in its radial direction, thereby further improving the sealing reliability. Similarly, the length of the second spiral sealing ring 241 can be disposed to be at least one circle, so that the second sealing section 24 formed by the plurality of second spiral sealing rings 241 has a sufficient sealing length in its radial direction, thereby ensuring the sealing reliability.

The above are only the preferred embodiments of the present invention, and are not construed as a limit to the present invention. Any modification, equivalent replacement, improvement, etc. made within the spirit and principle of the present invention all shall be included in the scope of protection of the present invention.

What is claimed is:

1. A spiral deployed isolation tool, comprising:

a mandrel having an outer surface in a conical shape, wherein the mandrel has an axial through hole;

an anchoring sealing structure, wherein the anchoring sealing structure is matched and sleeved on the outer surface of the mandrel, the anchoring sealing structure has a first sealing section and an anchoring section, the first sealing section is located at a larger end of the mandrel, the anchoring section comprises a plurality of slips, the first sealing section comprises a plurality of first spiral sealing rings, each of the plurality of slips corresponds to each of the plurality of first spiral sealing rings to respectively form a first structure, and the plurality of first spiral sealing rings is nested with each other to form the first sealing section, wherein, the anchoring sealing structure has a locking body, the locking body is located at a smaller end of the mandrel, the mandrel is provided with a locking structure fitted with the locking body, the locking body comprises a plurality of spiral locking rings, each of the plurality of slips corresponds to each of the plurality of spiral locking rings to respectively form a second structure, and the plurality of spiral locking rings is nested with each other to form the locking body.

2. The spiral deployed isolation tool of claim 1, wherein the locking structure is a locking groove, and a width of the locking groove in an axial direction of the mandrel is larger than a pitch of each of the plurality of spiral locking rings.

3. The spiral deployed isolation tool of claim 2, wherein the locking groove is a locking concave groove, the locking concave groove has a groove side in the radial direction of the mandrel, the groove side far away from the smaller end of the mandrel is an inclined side, and an opening of the inclined side is far away from the smaller end of the mandrel.

4. The spiral deployed isolation tool of claim 3, wherein the mandrel is provided with a sealing rubber cylinder and a stop ring, a first end of the sealing rubber cylinder is butted with the first sealing section, and a second end of the sealing rubber cylinder is butted with the stop ring.

5. The spiral deployed isolation tool of claim 2, wherein the pitch of each of the plurality of spiral locking rings is smaller than the width of the locking groove in the axial direction of the mandrel, and the width of the locking groove in the axial direction of the mandrel is smaller than a pitch of each of the plurality of first spiral sealing rings.

6. The spiral deployed isolation tool of claim 5, wherein the mandrel is provided with a sealing rubber cylinder and a stop ring, a first end of the sealing rubber cylinder is butted with the first sealing section, and a second end of the sealing rubber cylinder is butted with the stop ring.

7. The spiral deployed isolation tool of claim 2, wherein the anchoring sealing structure has a second sealing section, the second sealing section is located between the anchoring section and the locking body, the second sealing section comprises a plurality of second spiral sealing rings, each of the plurality of second spiral sealing rings is located on extending lines of spiral lines of each of the plurality of spiral locking rings, and correspond to the plurality of slips to respectively form a structure, and the plurality of second spiral sealing rings is nested with each other to form the second sealing section.

8. The spiral deployed isolation tool of claim 7, wherein the pitch of the spiral locking ring is smaller than the width of the locking groove in the axial direction of the mandrel, and the width of the locking groove in the axial direction of the mandrel is smaller than a pitch of each of the plurality of second spiral sealing rings.

9. The spiral deployed isolation tool of claim 8, wherein the mandrel is provided with a sealing rubber cylinder and a stop ring, a first end of the sealing rubber cylinder is butted with the first sealing section, and a second end of the sealing rubber cylinder is butted with the stop ring.

10. The spiral deployed isolation tool of claim 7, wherein an outer surface of each of the plurality of second spiral sealing rings is provided with a sealing protrusion.

11. The spiral deployed isolation tool of claim 2, wherein the mandrel is provided with a sealing rubber cylinder and a stop ring, a first end of the sealing rubber cylinder is butted with the first sealing section, and a second end of the sealing rubber cylinder is butted with the stop ring.

12. The spiral deployed isolation tool of claim 7, wherein the mandrel is provided with a sealing rubber cylinder and a stop ring, a first end of the sealing rubber cylinder is butted with the first sealing section, and a second end of the sealing rubber cylinder is butted with the stop ring.

13. The spiral deployed isolation tool of claim 1, wherein a surface of the locking structure and an inner surface of the locking body are provided with a plurality of locking teeth matched with each other.

14. The spiral deployed isolation tool of claim 13, wherein the mandrel is provided with a sealing rubber cylinder and a stop ring, a first end of the sealing rubber cylinder is butted with the first sealing section, and a second end of the sealing rubber cylinder is butted with the stop ring.

15. The spiral deployed isolation tool of claim 1, wherein the mandrel is provided with a sealing rubber cylinder and a stop ring, a first end of the sealing rubber cylinder is butted with the first sealing section, and a second end of the sealing rubber cylinder is butted with the stop ring.

16. The spiral deployed isolation tool of claim 15, wherein the stop ring is a spiral stop ring.

17. The spiral deployed isolation tool of claim 1, wherein an outer surface of each of the plurality of first spiral sealing rings is provided with a sealing protrusion.

* * * * *